US005905693A

United States Patent [19]

Dubois

[11] Patent Number: 5,905,693

[45] Date of Patent: May 18, 1999

[54] ISOLATION MOUNT FOR AN ACOUSTIC DEVICE

[75] Inventor: Neil J. Dubois, Cranston, R.I.

[73] Assignee: The United States of America as represented by the Secretary of the Navy, Washington, D.C.

[21] Appl. No.: 09/054,316

[22] Filed: Mar. 31, 1998

[51] Int. Cl.[6] ..... H04R 23/00

[52] U.S. Cl. ..... 367/173; 367/176

[58] Field of Search ..... 367/165, 173, 367/176

[56] References Cited

U.S. PATENT DOCUMENTS

| | | | |
|---|---|---|---|
| 2,560,066 | 7/1951 | Batchelder | 367/173 |
| 3,753,219 | 8/1973 | King, Jr. | 367/173 |
| 4,463,454 | 7/1984 | Hemond et al. | 367/173 |

*Primary Examiner*—Ian J. Lobo
*Attorney, Agent, or Firm*—Michael J. McGowan; Prithvi C. Lall; James M. Kasischke

[57] ABSTRACT

An isolation mount mounts a device, such as an acoustic projector or transducer, to a hull structure while mechanically and acoustically isolating the device from the hull structure. The isolation mount comprises an isolation collar made of an elastomeric material that surrounds at least a portion of the device. A device mounting member made of rigid material is coupled to one end of the isolation collar, for mounting to the device, while a hull mounting member made of a rigid material is coupled to the other end of the isolation collar for mounting to the hull structure. At least a portion of the device is received within a device receiving region formed by the device mounting member and the isolation collar. The isolation mount is adapted to be used with an existing mounting arrangement, such as around an existing aperture in a hull structure, and is capable of providing a waterproof mount.

21 Claims, 3 Drawing Sheets

ISOLATION MOUNT FOR AN ACOUSTIC DEVICE

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates to isolation mounts and in particular, to an isolation mount for mounting an acoustic projector or transducer to a hull structure of an underwater vehicle.

(2) Description of the Prior Art

Acoustic projectors are commonly used in underwater vehicles to generate sound which propagates through the water, for example, as part of an underwater vehicle guidance system. In the past, acoustic projectors 10, FIG. 1, have been mounted directly in the wall 12 of the cylindrical hull 14 of the underwater vehicle. Typically, the hull 14 includes a cavity or aperture 16 cut through the wall 12. The acoustic projector 10 is received through the cavity 16 and is fastened to the hull with bolts 18 such that the projector 10 forms a flush contour with the hull 14. An 'O' ring seal 19 typically provides a water tight seal between the acoustic projector 10 and the wall 12 of the hull 14. Similarly, transducers used to detect and measure energy, such as acoustic energy, are also mounted directly to the hull 14 of an underwater vehicle.

An acoustic projector 10 is generally designed to have certain characteristics with respect to frequency response and range of operation. The way in which the acoustic projectors are mounted directly to the underwater vehicle hull adversely interferes with the operation of the acoustic projector. When sound is generated by the acoustic projector, energy from the projector is coupled into or transmitted to the hull structure, resulting in resonances and interference with the sound being propagated into the water. The frequency response of the acoustic projector is thereby degraded and will adversely affect the guidance system or other system in which the acoustic projector is used. Vibrations and acoustic energy generated by or transmitted through the hull structure to the projector can also interfere with operation of the projector.

Some attempts have been made to mechanically and acoustically isolate noise generating devices and transducers from a support structure. Existing isolation mounts, however, are not capable of being retrofitted with existing mounting arrangements without physically modifying the hull structure and/or the projector. Existing isolation mounts also do not provide the water tight seal that may be necessary when mounting acoustic projectors or other devices to the hull of an underwater vehicle.

SUMMARY OF THE INVENTION

One object of the present invention is providing an isolation mount for mounting an acoustic projector or other device to a hull structure while mechanically and acoustically isolating the acoustic projector or other device from the hull structure.

Another object of the present invention is providing an isolation mount that can be easily retrofitted to an existing mounting arrangement or aperture in a hull structure without physically modifying the device being mounted and/or the hull structure.

A further object is providing an isolation mount that effectively mounts an acoustic projector or other device to the hull structure of an underwater vehicle with a water tight seal.

The present invention features an isolation mount for mounting a device to a hull structure and isolating the device from the hull structure. The isolation mount comprises an isolation collar made of an elastomeric material for surrounding at least a portion of the device. The isolation collar has a first end adapted to be mounted to the hull structure. A device mounting member made of a rigid material is coupled to the second end of the isolation collar, for mounting to the device. The device mounting member and the isolation collar form a device receiving region for receiving at least part of the device to be isolated from and mounted to the hull structure. A hull mounting member made of a rigid material is preferably coupled to the first end of the isolation collar for mounting to the hull structure.

According to the preferred embodiment, the isolation mount is mounted around an aperture extending through the wall of the hull structure. The device mounting member and the hull mounting member are preferably bonded to the isolation collar, thereby providing a water tight isolation mount. The isolation mount further includes a device sealing member disposed around a surface of the device receiving region, such as an inner surface of the device mounting member, for sealing against the device. A hull sealing member can be disposed against a surface of the hull mounting member for sealing against the hull structure.

One embodiment of the isolation collar has an annular shape, and the device mounting member and hull mounting member preferably have a substantially annular shape. The isolation collar is preferably made of a polyurethane material or other suitable energy absorbing material.

In one embodiment, the device mounting member includes a device mounting flange adapted to receive at least one fastener for fastening to the device, and the hull mounting member includes a hull mounting flange adapted to receive at least one fastener for fastening to the hull structure.

According to another embodiment, the device mounting member includes a device clamping mechanism for clamping to the device, and the hull mounting member includes a hull clamping mechanism for clamping the walls of the hull structure.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 2:
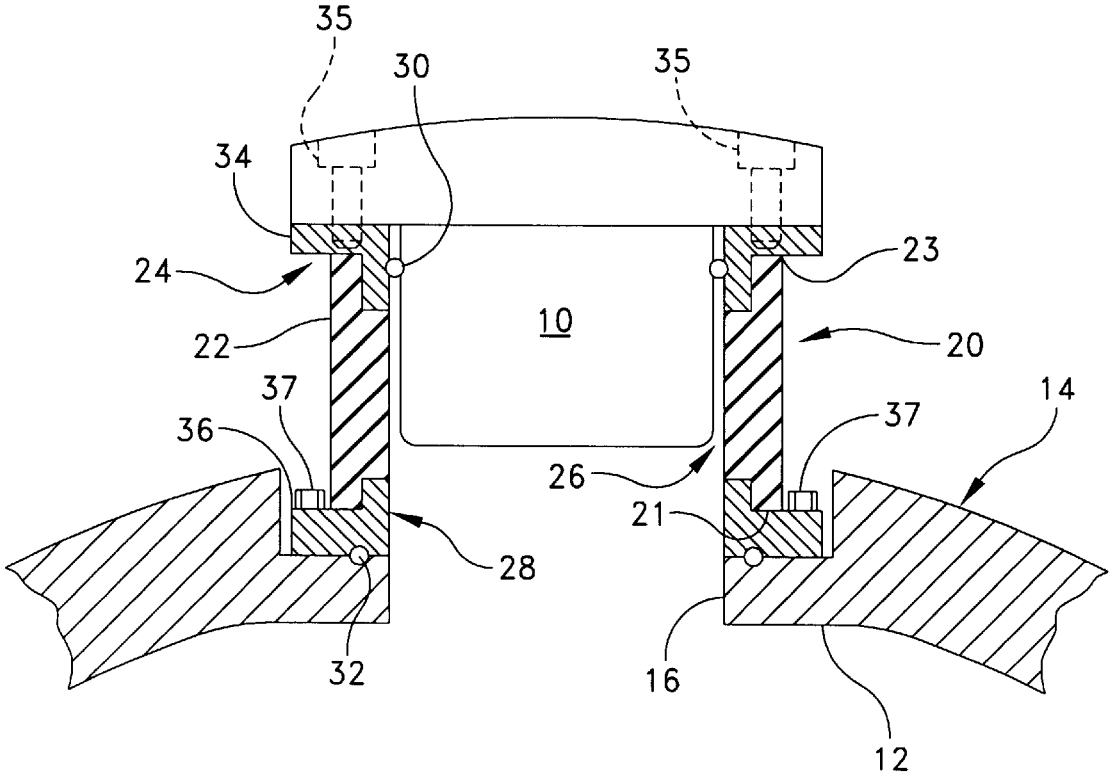
FIG. 2 is a partially cross-sectional, side view of an isolation mount, according to one embodiment of the present invention, mounting a device to a hull structure.

An isolation mount 20, FIG. 2, according to the present invention, is used to mount a device 10, such as an acoustic projector or transducer, to a hull structure 14 and to mechanically and acoustically isolate the device 10 from the hull structure 14. An exemplary embodiment of the isolation mount 20 is around an aperture 16 extending through the wall 12 of the hull structure 14, such as the existing aperture in which acoustic projectors or transducers 10 are directly mounted to the hull 12 of an underwater vehicle. The present invention, however, contemplates using the isolation mount 20 to mount and isolate other types of devices to other types of structures.

The isolation mount 20 includes an isolation collar 22 formed from elastomeric material, such as polyurethane or other energy absorbing materials, for surrounding at least a portion of the device 10. A first end 21 of the isolation collar 22 is adapted to be mounted to the hull structure 14, as described below. A device mounting member 24 made of a rigid material, such as aluminum, is coupled to a second end 23 of the isolation collar 22, for mounting to the device 10. The device mounting member 24 and the isolation collar 22 thereby form a device receiving region 26 that receives at least a portion of the device 10 to be isolated from the hull structure 14.

The isolation collar 22 formed as a column or annular ring of elastomeric or flexible material provides adequate support for the device 10 mounted to the hull structure 14, while also providing a spring mass system with damping characteristics that achieves a high degree of isolation. The isolation collar 22 thereby mechanically and acoustically isolates the device 10 from the hull structure 14. Energy generated by the device 10, such as acoustic energy generated by an acoustic projector, is prevented from being transmitted to the hull structure 14 and degrading the frequency response of the device 10. Energy generated by and/or transmitted through the hull structure 14 is also prevented from adversely affecting the operation of the device 10.

According to the preferred embodiment, a hull mounting member 28 made of a rigid material, such as aluminum, is coupled to the first end 21 of the isolation collar 22, for mounting to the hull structure 14. The device mounting member 24 and hull mounting member 28 are preferably bonded to the isolation collar 22 to form a water tight unit. In one example, the elastomeric material, such as a castable polyurethane of the type known as Hexcel Uralite 3140, is molded in place and bonded to the device mounting member 24 and hull mounting member 28. Castable polyurethanes can be molded in place using open pour molds where required. The mating surfaces of the device mounting member 24 and the hull mounting member 28 are coated with a primer such as PRC 420. The polyurethane is then introduced into the mold, and when cured is firmly bonded to the device mounting member 24 and the hull mounting member 28. This produces a stronger bond than that available with a post adhesive process.

The preferred embodiment of the isolation mount 20 further includes a device sealing member 30 disposed around a surface of the device receiving region 26, such as an 'O' ring seal disposed around an interior surface of the device mounting member 24, for providing a water tight seal between the device 10 and the isolation mount 20. A hull sealing member 32 is preferably disposed against a surface of the hull mounting member 28, to provide a water tight seal between the isolation mount 20 and the hull structure 14.

Figure 1:
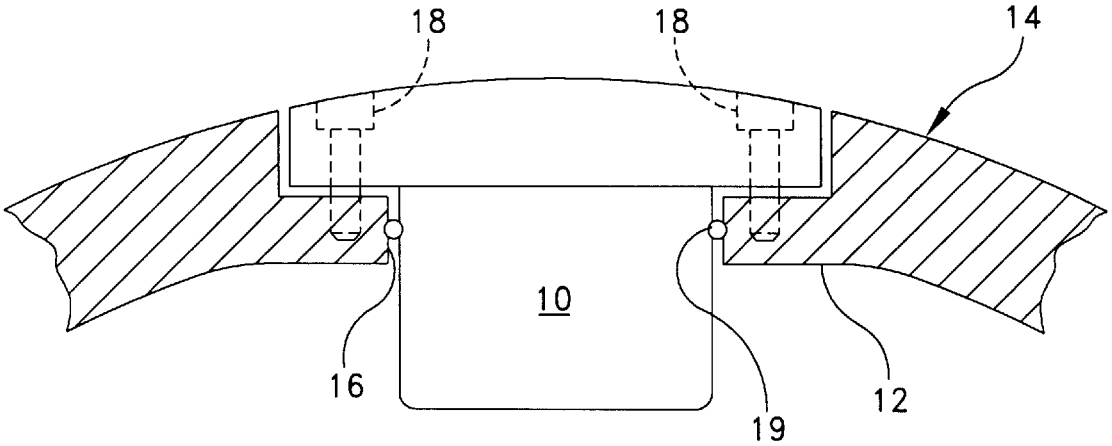
FIG. 1 (PRIOR ART)
FIG. 1 is a partially cross-sectional view of an acoustic projector mounted directly to a hull structure according to the prior art.

The isolation mount 20 thereby mounts a device 10 to a hull structure 14 around an existing aperture 16 in the hull structure 14 in which the device 10 was previously directly mounted (see FIG. 1), without requiring physical modifications of the device 10 or the hull structure 14, thereby allowing the present isolation mount to be retrofit into existing structures. The isolation mount 20 further mounts the device around the aperture 16 in a manner that prevents water leakage into the hull structure 14, for example, when used on an underwater vehicle.

In one embodiment, the device mounting member 24 includes a device mounting flange 34 adapted to receive one or more fasteners 35, such as bolts, for fastening the device 10 to the device mounting member 24. One embodiment of the hull mounting member 28 includes a hull mounting flange 36 that is adapted to receive one or more fasteners 37, such as bolts, to fasten the hull mounting member 28 to the wall 12 of the hull structure 14. The device mounting member 24 and hull mounting member 28 also preferably have an L-shaped cross-section or stepped configuration to improve the bonding with the castable polyurethane material of the isolation collar 22.

Figure 3:
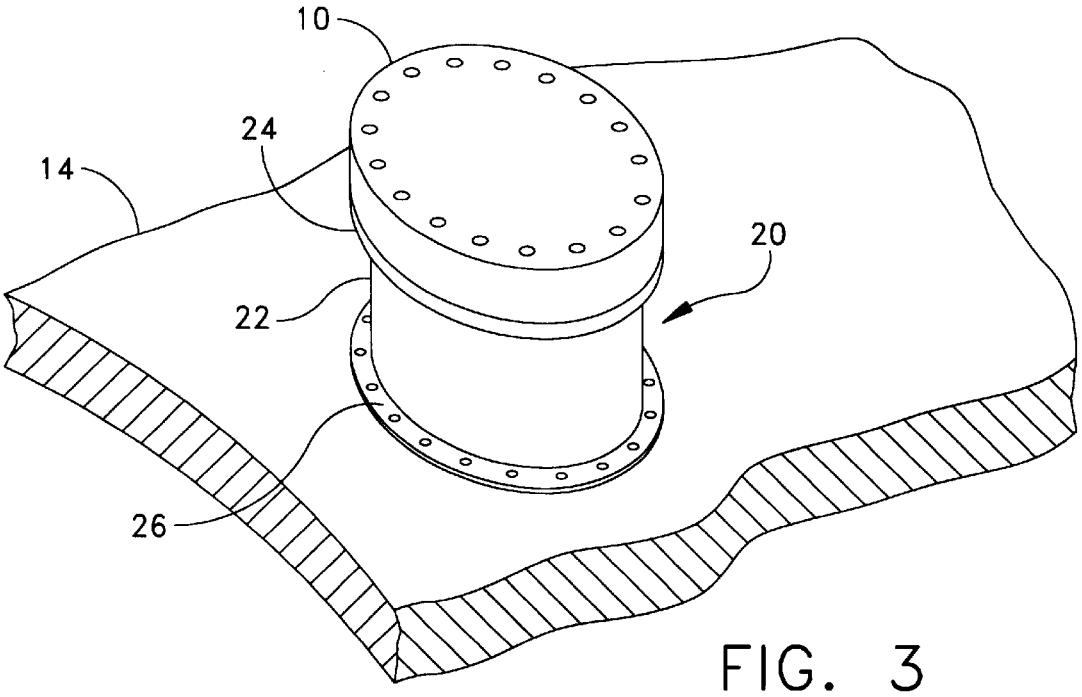
FIG. 3 is a perspective view of a device mounted to a hull structure with the isolation mount of the present invention.

In one example, the isolation mount 20, FIG. 3, has a substantially cylindrical shape and size corresponding to the shape and size of the device 10 and the shape and size of the existing aperture within the hull structure 14 in which the device 10 was previously directly mounted. The present invention contemplates various shapes and sizes of the isolation mount 20 to be used with different shapes and sizes of the devices 10 to be mounted and isolated such as oval, square and rectangular.

Figure 4:
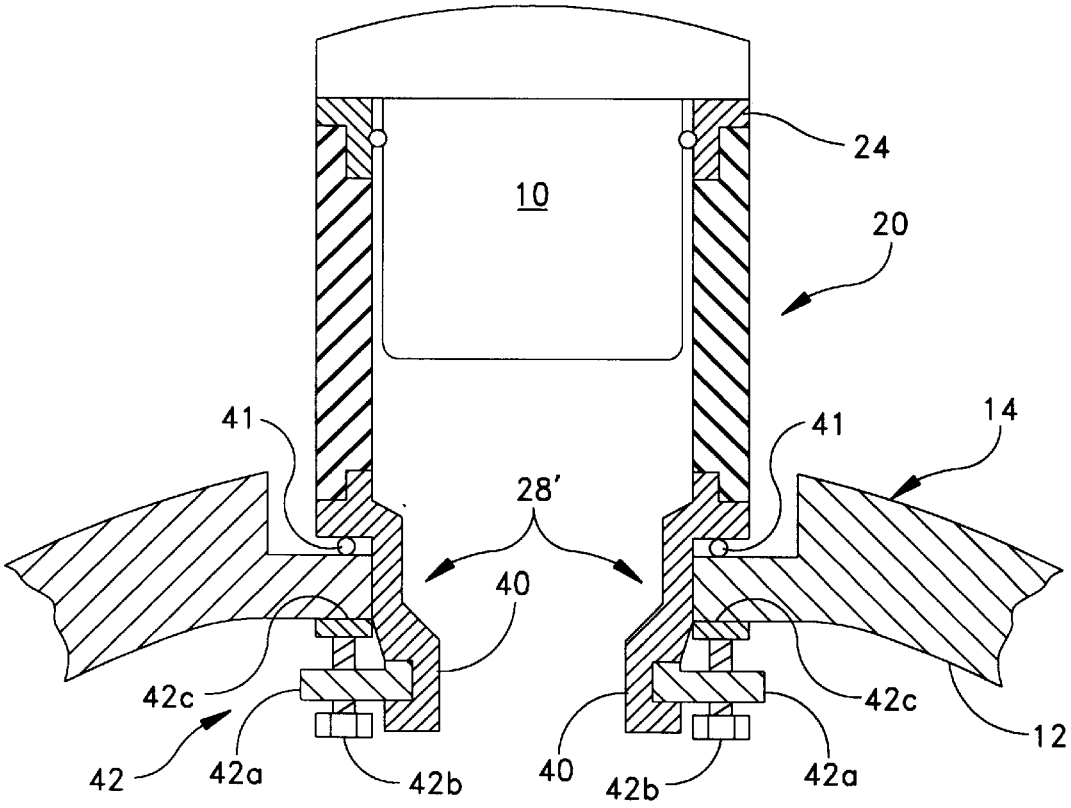
FIG. 4 is a partially cross-sectional, side view of an isolation mount, according to another embodiment of the present invention.

According to another embodiment of the isolation mount 20, FIG. 4, the hull mounting member 28' includes a clamping member 40 that is clamped against the wall 12 of the hull structure 14 with a clamping mechanism 42, such as a clamping mechanism previously used to mount the device 10 directly to the hull structure 14. A gasket 41 can be positioned between clamping member 40 and wall 12 opposite clamping member 40. Clamping mechanism 42 includes a compression ring **42*a*, fasteners 42*b*, and bearing surface 42*c*. The fasteners 42*b* extend through apertures in the compression ring 42*a* and the bearing surface 42*c* applies a force against the wall 12 as the fasteners 42*b* are tightened. The compression ring 42*a* causes clamping member 40 to compress against gasket 41**. The present invention contemplates hull mounting members of various shapes and sizes to fit with various types of hull structures and existing hull mounting arrangements or mechanisms.

Figure 5:
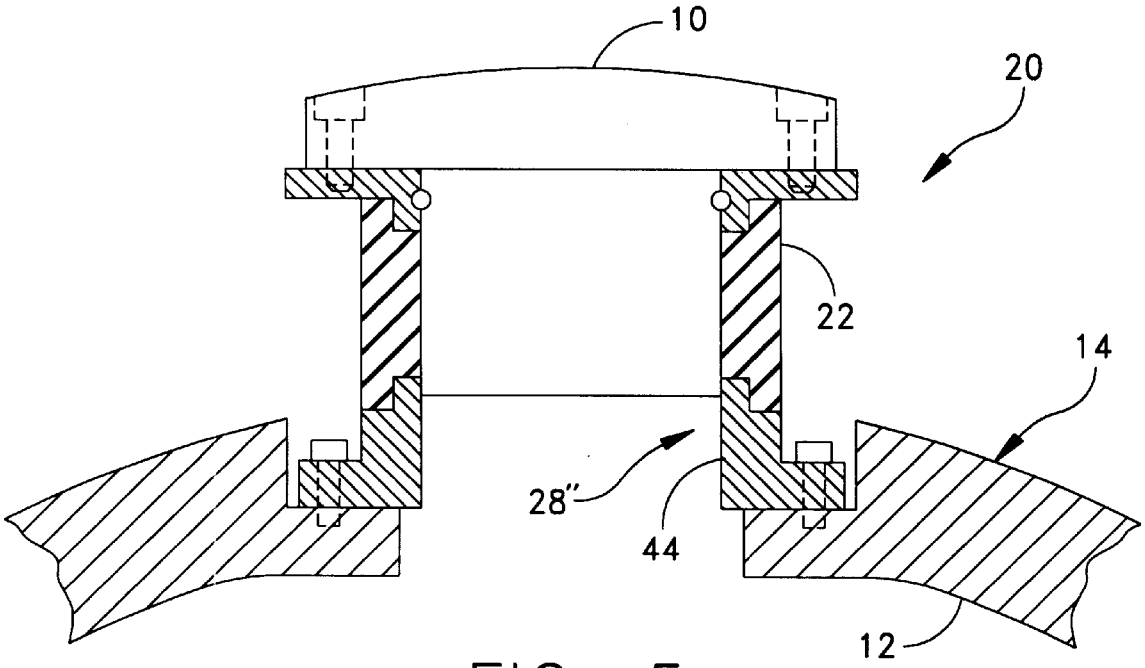
FIG. 5 is a partially cross-sectional, side view of an isolation mount, according to a further embodiment of the present invention.

According to other embodiments of the isolation mount 20, FIG. 5, the isolation collar 22 has a varying height, thickness, and modulus of elasticity to obtain varying degrees of isolation depending upon the size, weight, and frequency range of the acoustic projector or other device 10 and the hydrostatic pressure at which the isolation mount 20 will be subjected. For example, the isolation collar 22 could be shortened and the hull mounting member 26 could include an extension 44 extending outwardly from the hull structure 14.

Figure 6:
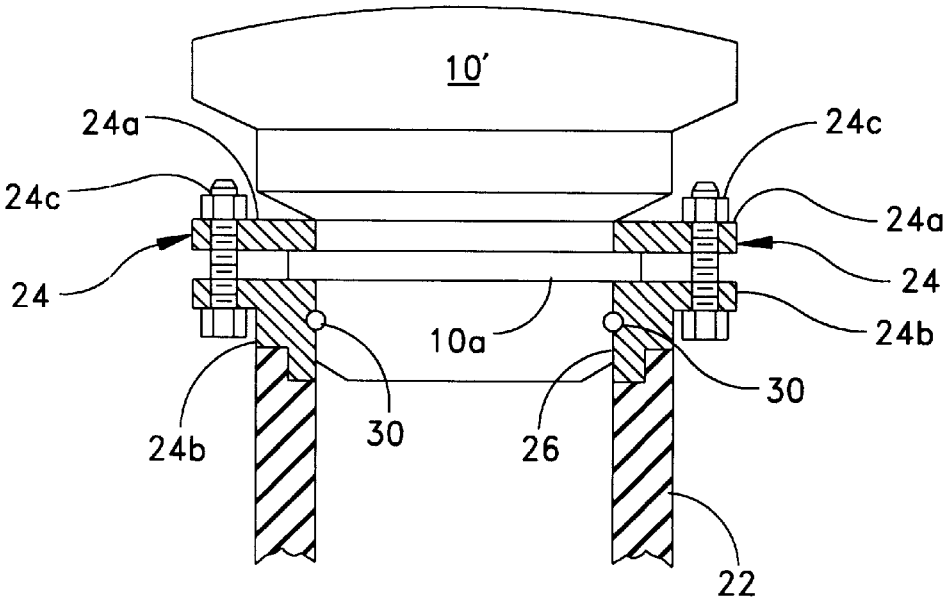
FIG. 6 is a partially cross-sectional, side view of an isolation mount, according to a further embodiment of the present invention.

FIG. 6 shows an alternative method for mounting an acoustic device 10' on the isolation mount of the current invention. Device 10' includes an acoustic device flange **10*a***.

Mounting member 24 includes a circular compression member 24*a*, a mount 24*b* and fasteners 24*c*. Member 24*a* and mount 24*b* have complementary apertures therein through which fasteners 24*c* are inserted. In use, device 10' is inserted in mount 24*b* such that flange 10*a* contacts mount 24*b*. Member 24*a* is placed on top of flange 10*a* such that apertures align. Fasteners 24*c* are inserted through apertures and tightened to compress flange 10*a* between mount 24*b* and member 24*a*. The hull mounting member can be any hull mounting member shown in another embodiment.

Accordingly, the isolation mount of the present invention securely mounts a device, such as an acoustic projector or transducer, to a hull structure, such as an underwater vehicle, and mechanically and acoustically isolates the device from the hull structure to prevent the adverse affects of energy transmitted between the device and the hull structure. The isolation mount of the present invention also allows the device to be mounted and isolated at an existing location at which the device was previously mounted directly to the hull structure without requiring physical modification of the device or the hull structure.

In light of the above, it is therefore understood that within the scope of the appended claims, the invention may be practiced otherwise than as specifically described.

What is claimed is:

1. An isolation mount for mounting a device to a hull structure comprising:

an isolation collar made of an elastomeric material for surrounding at least a portion of said device, said isolation collar having a first end and a second end, wherein said first end is adapted to be mounted to said hull structure; and a device mounting member made of a rigid material and coupled to said second end of said isolation collar, for mounting to said device, wherein said device mounting member and said isolation collar cooperate to form a device receiving region for receiving at least part of said device to be isolated from said hull structure.

2. The isolation mount of claim 1 further including a device sealing member disposed around a surface of said device receiving region, for sealing against said device.

3. The isolation mount of claim 1 wherein said device mounting member is bonded to said isolation collar.

4. The isolation mount of claim 1 wherein said device mounting member includes a device mounting flange, adapted to receive at least one fastener, for fastening to said device.

5. The isolation mount of claim 1 wherein said device mounting member includes a device clamping mechanism, for clamping said device.

6. The isolation mount of claim 5 wherein said device clamping mechanism includes a compression member disposed against a flange of said device and at least one fastener extending through said device mounting member and said compression member, wherein said at least one fastener is tightened to compress said compression member and said device mounting member against said flange of said device.

7. The isolation mount of claim 1 further including a hull mounting member made of a rigid material and coupled to said first end of said isolation collar, for mounting to said hull structure.

8. The isolation mount of claim 7 further including a hull sealing member disposed against a surface of said hull mounting member, for sealing against said hull structure.

9. The isolation mount of claim 7 wherein said hull mounting member is bonded to said isolation collar.

10. The isolation mount of claim 7 wherein said hull mounting member includes a hull mounting flange adapted to receive at least one fastener, for fastening to said hull structure.

11. The isolation mount of claim 7 wherein said hull mounting member includes at least one hull clamping mechanism, for clamping walls of said hull structure.

12. The isolation mount of claim 11 wherein said hull clamping mechanism includes a compression ring disposed against a flange of said hull mounting member, at least one fastener extending through said compression ring, and a bearing surface disposed between said at least one fastener and said wall of said hull structure, wherein said at least one fastener tightens to cause said bearing surface to apply pressure against said wall of said hull structure and to cause said compression ring to compress said hull mounting member against said hull structure opposite said bearing surface.

13. The isolation mount of claim 1 wherein said isolation collar has an annular shape, and wherein said device mounting member has an annular shape.

14. The isolation mount of claim 1 wherein said isolation collar is made of a polyurethane material.

15. An isolation mount for mounting a device to a hull structure having an aperture, said isolation mount comprising:

an isolation collar made of an elastomeric material having a first end and a second end;

a hull mounting member, made of a rigid material and coupled to said first end of said isolation collar, for mounting to said hull structure and around said aperture in said hull structure;

a hull sealing member, disposed against a surface of said hull mounting member, for sealing against said hull structure and around said aperture in said hull structure;

a device mounting member, made of a rigid material and coupled to said second end of said isolation collar, for mounting to said device, wherein said device mounting member and said isolation collar form a device receiving region for receiving at least part of said device; and a device sealing member disposed around a surface of said devi receiving region, for sealing against said device.

16. The isolation mount of claim 15 wherein said device mounting member includes a device mounting flange, adapted to receive at least one fastener, for fastening to said device.

17. The isolation mount of claim 15 wherein said device mounting member includes a device clamping mechanism, for clamping said device.

18. The isolation mount of claim 17 wherein said device clamping mechanism includes compression member disposed against a flange of said device and at least one fastener extending through said device mounting member and said compression member, wherein said at least one fastener is tightened to compress said compression member and said device mounting member against said flange of said device.

19. The isolation mount of claim 15 wherein said hull mounting member includes a hull mounting flange adapted to receive at least one fastener, for fastening to said hull structure.

20. The isolation mount of claim 15 wherein said hull mounting member includes at least one hull clamping mechanism, for clamping walls of said hull structure.

21. The isolation mount of claim 20 wherein said hull clamping mechanism includes a compression ring disposed against a flange of said hull mounting member, at least one fastener extending through said compression ring, and a bearing surface disposed between said at least one fastener and said wall of said hull structure, wherein said at least one fastener tightens to cause said bearing surface to apply pressure against said wall of said hull structure and to cause said compression ring to compress said hull mounting member against said hull structure opposite said bearing surface.

* * * * *